United States Patent [19]

Hauser

[11] 4,334,644

[45] Jun. 15, 1982

[54] DISPENSER CARTON

[75] Inventor: Donald P. Hauser, Cincinnati, Ohio

[73] Assignee: The C. W. Zumbiel Co., Cincinnati, Ohio

[21] Appl. No.: 151,188

[22] Filed: May 19, 1980

[51] Int. Cl.[3] ..... B26D 1/02

[52] U.S. Cl. ..... 225/43; 225/48; 225/49; 225/84; 225/90

[58] Field of Search ..... 225/48–52, 225/43, 84, 90, 25, 74, 75, 86; 206/395, 396; 229/175

[56] References Cited

U.S. PATENT DOCUMENTS

| | | | |
|---|---|---|---|
| 1,961,511 | 6/1934 | Sinclair | 225/50 X |
| 2,000,867 | 5/1935 | Spaldo | 225/52 X |
| 2,314,849 | 3/1943 | Sullivan et al. | 225/48 X |
| 2,331,651 | 10/1943 | Broeren | 225/50 X |
| 2,633,985 | 4/1953 | Meyer | 225/43 X |
| 2,713,939 | 7/1955 | Lear | 225/50 |
| 2,888,181 | 5/1959 | Lincoln et al. | 225/51 |
| 2,893,616 | 7/1959 | Stell | 225/52 |
| 2,936,936 | 5/1960 | Sano | 225/50 X |
| 3,028,060 | 4/1962 | Haley | 225/25 |
| 3,933,288 | 1/1976 | Struble | 225/49 |
| 4,005,809 | 2/1977 | Finn | 225/49 |

*Primary Examiner*—Frank T. Yost

*Attorney, Agent, or Firm*—Wood, Herron & Evans

[57] ABSTRACT

A dispenser carton for dispensing sheet material, e.g., household wrap type sheet material. A unique cutting edge structure for the carton permits tearing off a length of sheet material withdrawn from a supply roll inside the carton, while simultaneously braking the sheet material remaining on the roll during the tearing step to prevent inadvertent withdrawal of additional sheet material. In preferred form, the cutting edge structure is comprised of an abrasive applied to the free edge of the carton's closure flap, the abrasive being on the inside face of that closure flap. After the desired sheet material length is withdrawn from the roll within the carton, the carton's cover is closed and the closure flap is manually pressured against the carton's front wall. In this attitude, the abrasive and the closure flap's leading edge cooperate to provide a cutting edge by which the free length of sheet material can be torn off the supply roll from one edge to the other. Also in this use attitude, the abrasive on the closure flap's inside face cooperates with the carton's front wall to aid in preventing inadvertent withdrawal of additional sheet material from the carton as the free length is torn off the supply roll.

2 Claims, 5 Drawing Figures

DISPENSER CARTON

This invention relates to dispenser cartons. More particularly, this invention relates to a dispenser carton having a novel and unique cutting edge structure.

Dispenser cartons for sheet material are, of course, very well known to the prior art. One very wide spread use for such dispenser cartons is in the marketing of household wrap type sheet material. This type sheet material is commonly used in the home for protecting foodstuffs. Typically, household wrap type sheet material is sold in roll form, the supply roll being positioned in a dispenser carton that is sealed during distribution of the product from manufacturer to consumer. The dispenser carton also incorporates a tearing or cutting edge in the carbon structure. In use, and as a consumer withdraws a desired length of sheet material from the carton, the sheet is positioned to overlie the carton's cutting edge and is torn from one edge of the sheet to the other through use of that cutting edge from the continuous length left on the roll. Typical of such consumer type sheet material marketed through use of roll dispenser cartons are wax paper, aluminum foil, freezer paper, and various polymeric films. The polymeric films include, for example, polyethylene film and film produced from a copolymer of vinylidine chloride and vinyl chloride.

It is very well known to the prior art to incorporate a cutting or tearing edge structure with a roll dispenser carton. Perhaps the most widely used structure to-date from a commercial standpoint makes use of a serrated cutting edge attached to a paperboard dispenser carton, for example, along the carton's front wall/floor corner so that the serrated edge extends slightly beyond that corner. A typical prior art disclosure of a dispenser carton with metal serrated tearing edge at the carton's front wall/floor corner is illustrated in U.S. Pat. No. 1,364,743. Other directions taken in the prior art provide the carton's serrated cutting edge at the top edge of the carton's front wall, or on the free edge of the carton's closure flap. Typical of prior art disclosures illustrating these latter two approaches are cartons disclosed in U.S. Pat. No. 2,936,936 and in U.S. Pat. No. 3,642,185. In each of these prior art carton structures, the carton's user tears off sheet material, unrolled from within that carton, along the serrated edge at the length desired. There are, of course, a number of additional dispenser carton structures illustrated in other patent art.

In the prior art carton structures noted above, it is known to fabricate the serrated edge from a separate metal strip or blade that has a serrated edge along one edge of the blade from one end to the other. This metal strip is attached to the carton to provide the carton's serrated cutting edge. But this metal serrated strip or blade has a couple of disadvantages from a commercial use standpoint. One disadvantage is that a metal serrated blade may pose a potential safety problem to a careless user in that the user's fingers may be inadvertently cut. Another disadvantage is that a metal serrated blade may scratch or otherwise damage wood or metal items in the user's home. Further, a separate metal blade that must be separately attached to the carton constitutes an additional part in the carton's structure which, of course, adds to the manufacturing cost of the carton. In addition, and with a metal strip or blade attached to a paper-board carton, some cartons tend to warp because of the difference in expansion coefficients between metal and paperboard, and this may cause problems in gluing and erecting of the carton blanks, and/or in filling of erected cartons with rolls of sheet material.

In recent years there have been attempts to develop dispenser cartons for the marketplace that have a tearing or cutting edge which does not incorporate a separate metal strip or blade. Such attempts have met with varying degrees of success, but to the best of my knowledge at the present time dispenser cartons with metal cutting edges for household wrap type sheet material still dominate the dispenser carton market directed to such sheet material. In that type of dispenser carton where the cutting edge structure is located at the carton's front wall/floor corner, one attempt comprises an abrasive strip applied onto the carton's front wall at that corner from one end to the other of the carton. This abrasive strip is comprised of a granular abrasive material adapted to cooperate with the carton's corner for severing a withdrawn length of sheet material that is pulled angularly against that corner. Such a carton structure is illustrated in U.S. Pat. No. 2,888,181.

Accordingly, it has been one objective of this invention to provide, particularly for a paperboard carton, a novel cutting edge structure located at the free edge of a movable carton panel, that cutting edge structure being structured to provide a cutting edge for sheet material within that carton, and to cooperate with another carton panel when pressured thereagainst to snub or brake the sheet material remaining in the carton for preventing inadvertent withdrawal of the remaining sheet material when a desired sheet length is being cut off through use of the cutting edge.

It has been another objective of this invention to provide, particularly for a paperboard carton, a novel and improved cutting edge structure located at the free edge of a first carton panel, the cutting edge structure comprising an abrasive strip applied to that face of the first panel adapted to move in and out of facial contact with an exposed face of a second carton panel, the abrasive strip cooperating with sheet material positioned between the two panels when the two panels are pressured against one another to tend to prevent inadvertent withdrawal of the sheet material from between those panels as it is being torn at a cutting edge defined by the abrasive and the free edge.

In accord with these objectives, the novel cutting edge structure of this invention, in preferred form, is incorporated in a novel dispenser carton for dispensing sheet material, e.g., household wrap type sheet material. The unique cutting edge structure for the carton permits tearing off a length of sheet material withdrawn from a supply roll inside the carton, while simultaneously braking the sheet material remaining on the roll during the tearing step to prevent inadvertent withdrawal of additional sheet material. In preferred form, the cutting edge structure is comprised of an abrasive applied to the free edge of the carton's closure flap, the abrasive being on the inside face of that closure flap. After the desired sheet material length is withdrawn from the roll within the carton, the carton's cover is closed and the closure flap is manually pressured against the carton's front wall. In this attitude, the abrasive and the closure flap's leading edge cooperate to provide a cutting edge by which the free length of sheet material can be torn off the supply roll form one edge to the other. Also in this attitude, the abrasive on the closure flap's inside face cooperates with the carton's front wall to aid in preventing inadvertent withdrawal of additional sheet material from the carton as the free length is torn off the supply roll.

Other objectives and advantages of this invention will be more apparent from the following detailed description taken in conjunction with the drawings in which.

Figure 1:
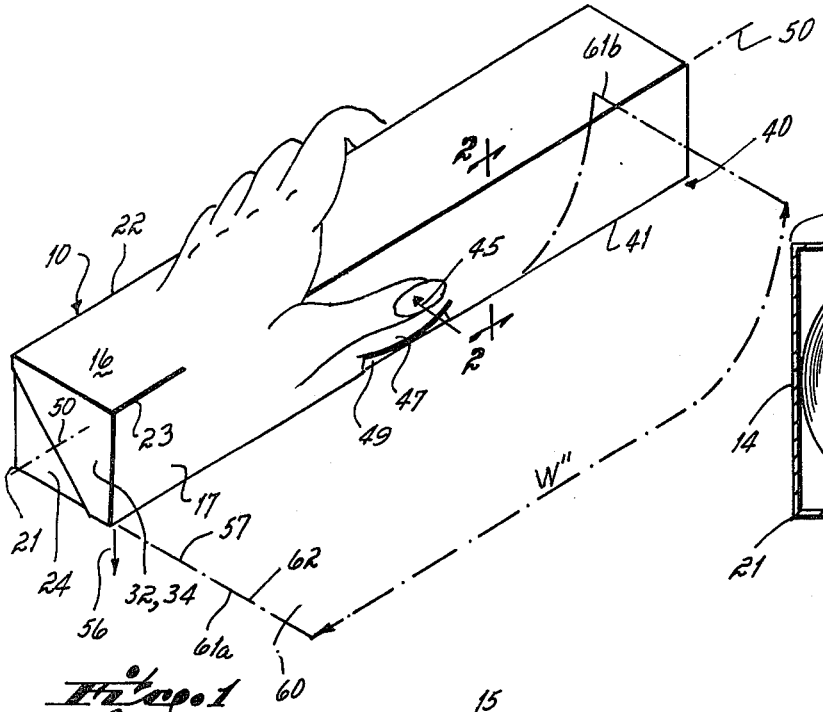
FIG. 1 is a novel roll type dispenser carton for household wrap type sheet material that incorporates a novel cutting edge in accord with the principles of this invention, the carton being shown fully erected.
Figure 3:
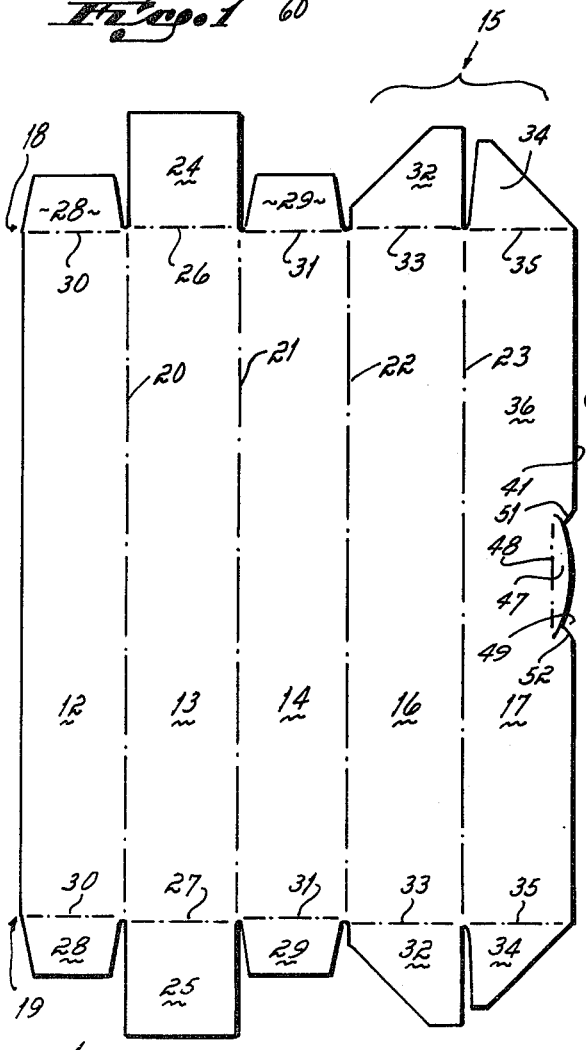
FIG. 3 is a plan view of one side of a carton blank from which the erected carton of FIG. 1 is assembled.

The dispenser carton 10 in accord with the principles of this invention, and the blank 11 from which that carton is fabricated, as shown in FIGS. 1 and 3, is preferably formed from paperboard. The carton 10 and blank 11 are comprised of a series of panels which include front wall 12, bottom wall 13, rear wall 14, and cover 15 comprised of top wall 16 and main closure flap 17. The front wall 12, bottom wall 13, rear wall 14, top wall 16, and main closure flap 17 are all connected one to the other integrally from one end edge 18 of each of those panels to the other end edge 19 of each of those panels at score or fold lines 20–23, respectively. In other words, the front wall 12, bottom wall 13, rear wall 14, top wall 16 and main closure flap 17 are all integral one with the other at the carton's corners 20–23 between ends 18, 19 of that carton 10, those panels 12, 13, 14, 16, 17 merely being folded relative one to the other at those corners when the carton is erected.

The carton 10 and carton blank 11 also includes end wall 24, 25 connected to opposite ends of the bottom wall 13 along score or fold lines 26, 27, respectively. Each end wall 24, 25 cooperates with end closure flaps 28, 29 connected to the front wall 12 and rear wall 14, respectively, along fold lines 30, 31, respectively. The end closure flaps 28, 29 are glued to their respective end walls 24, 25 upon assembly of the blank 11 into carton 10 configuration. Also, each end of the cover's top wall 16 has a tuck flap 32 connected thereto along fold line 33, and each end of the cover's closure flap 17 has a tuck flap 34 connected thereto along fold line 35. The tuck flaps 32, 34 at each end of the cover 15 are overlapped and glued one on top of the other upon assembly of the blank 10 into carton configuration so that the cover 15 remains of a generally right angular cross sectional configuration after assembly. Accordingly, and with the carton 10 erected, closure flap 17 is not pivotable relative to top wall 16, but the entire cover 15 is pivotable on hinge fold line 22 connection of that cover with rear wall 14. Therefore, the inside face 36 of closure flap 17 (i.e., a first carton panel) is movable into and out of facial contact with exposed or outside face 37 of front wall 12 (i.e., a second carton panel) when the carton's cover 15 is closed and opened, respectively, relative to the carton's interior as the cover pivots on hinge fold line 22.

Figure 2:
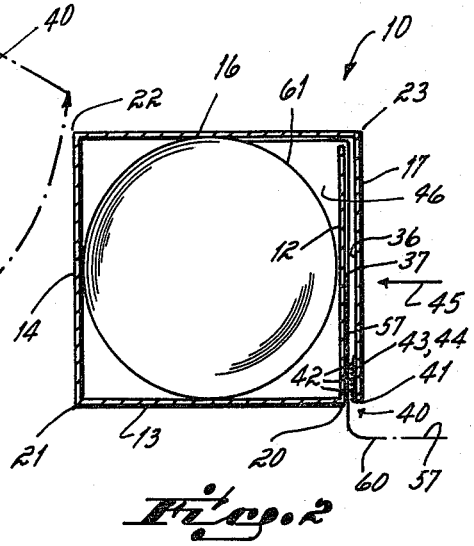
FIG. 2 is a cross sectional view taken along line 2—2 of FIG. 1.

The novel and unique tearing or cutting edge structure 40 for the novel carton as illustrated in blank form in FIG. 2, and in erected or use form in FIG. 1. The cutting edge structure 40 incorporates, in the carton 10 embodiment shown, the free edge 41 of the cover 15, i.e., the free edge 41 of the cover's closure flap 17. The cutting edge structure 40 includes an abrasive material 42 applied on a backing strip 43, the abrasive strip 44 so formed being fixed adjacent to the free edge 41 of the cover's closure flap 17 by an adhesive. Note particularly that the abrasive material 42 is located on the inside face 36 of the closure flap 17. In other words, the abrasive material 42 is positioned on the closure flap's free edge 41 so that same is in facial contact with the outside face 37 of the carton's front wall 12 when the cover 15 is closed. In this cover closed position, and as explained in greater detail below, pressure exerted by the carton's user, e.g., by the carton user's thumb, in generally perpendicular fashion (as shown by phantom arrow 45) on the cover's closure flap 17 toward the carton's interior 46 tends to press the abrasive strip 44 into pressured relation against the outside face 37 of the carton's front wall 12. The abrasive strip 44 extends from end edge 18 to end edge 19 of the cover's closure flap 17. And the abrasive strip 44 is of a width W substantially the same from one end to the other end of that strip, and is of a width W substantially less than height H of the cover's closure flap. The backing strip 44 on which the abrasive material 42 is applied cooperates with the free edge 41 of the carton's closure flap 17 to tend to reinforce or rigidify that free edge. Such reinforcement or rigidity is desirable when sheet material is cut or torn off from a roll stored in the carton, as described in greater detail below, as it tends to reduce undesirable flexing of the closure flap's free edge 41 during the tearing step. The abrasive material 42 on this abrasive strip 44 may be any conventional granular abrasive such as alumina, sand, silicon carbide, or the like. The abrasive material 42 and the carton closure flap's free edge 41 cooperate to define a cutting edge 40 on which sheet material and, particularly, household wrap type sheet material, may be easily torn.

Figure 4:
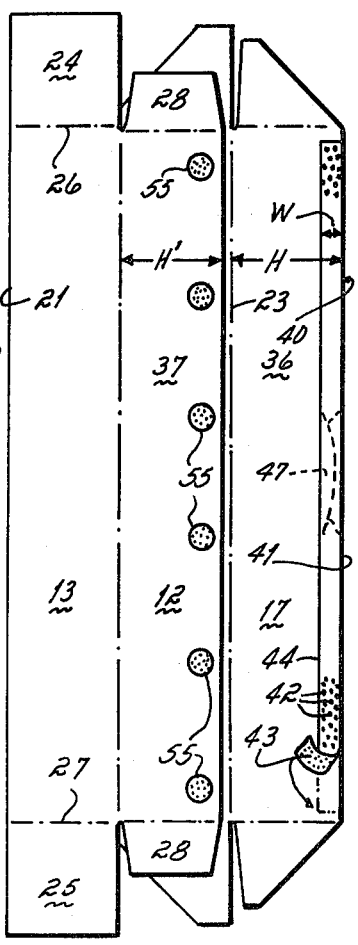
FIG. 4 is a plan view similar to FIG. 3 but illustrating the blank in a preliminary fold position during assembly of the carton.

The carton's cover 15 also includes a novel flap 47 by which the cover can be easily opened and closed by the carton's user. The finger flap 47 is of a generally semicircular configuration, is cut out of the cover's closure flap 17, and is foldably connected on fold line 48 to that closure flap. The finger flap's fold line 48 is oriented parallel to the free edge 41 of the cover's closure flap 17, and is spaced therefrom so it is located between the free edge and the top edge 23 of that closure flap. More particularly, the finger flap 47 is positioned in a notch 49 cut-out of the cover's closure flap 17, that notched-out section 49 being centrally located relative to the longitudinal axis 50 of the carton. Also in this regard, and as shown in FIG. 4, note that the abrasive strip 44, in effect, bridges the gap defined by side edges 51, 52 of the notch. But because the abrasive material 42 is applied to the backing strip 43, the integrity of the abrasive material 42 from one end edge 18 to the other end edge 19 of the closure flap's free edge 41, and the abrasive cutting edge 40 formed thereby, is maintained across the gap or notch 49 cut out of the closure flap's free edge 41. The finger flap 47 is, therefore, recessed relative to the abrasive cutting edge 40 at the closure flap's free edge 41, and does not extend beyond that free edge, thereby preventing any interference of the finger flap with sheet material 60 on roll 61 within the carton when a length 62 of that sheet material is being torn off the roll through use of the abrasive cutting edge 40.

Figure 5:
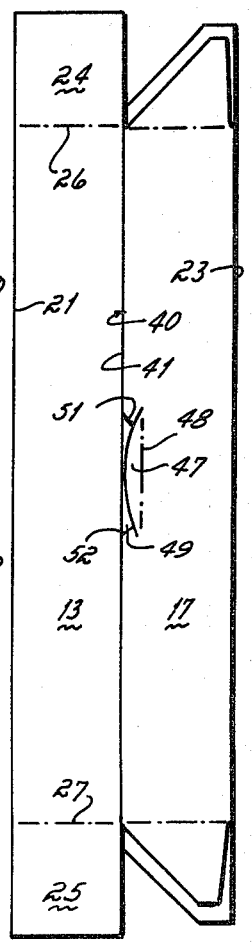
FIG. 5 is a plan view similar to FIG. 4 after assembly of the blank with the carton shown in knock-down or collapsed configuration.

Assembly of the blank 11 is illustrated in FIGS. 3, 4 and 5 from the blank configuration into the fabricated but knock-down configuration. As shown in FIG. 4, the blank of FIG. 3 is initially folded into a preliminary position so that the front wall 12 and bottom wall 13 panels overlie the top wall 16 and rear wall 14 panels, respectively, i.e., is folded on the corner fold line 21 that defines the erected carton's rear wall/top wall corner. In this attitude, the inside face of the front wall 12 overlies the inside face of the top wall 16 in facial contact therewith. This intermediate or preliminary fold position exposes the free edge 41 on the inside face 36 of the cover's closure flap 17 for adherence of an abrasive 42 coated backing strip 44 thereto. Also, this intermediate fold position exposes the outside face 37 of the carton's front wall 12 to application of glue spots 55 for gluing the cover's closure flap 17 thereto. After the abrasive strip 44 has been attached to the inside face 36 of the cover's closure flap 17, and after glue has been placed at spots 55 on the front wall's outside face 37, the closure flap is folded on fold line 23 until the inside face of the closure flap overlies the outside face of the front wall 12 panel in facial contact therewith, see FIG. 5. This results in the cover's closure flap 17 being glued to the front wall 12. With the carton's closure flap 17 glued to the carton's front wall 12, note that the width H of that closure flap is greater than the height H' of the front wall thereby, providing the carton 10 with a regular geometrical cross section with no protrusions therefrom at any of the carton's corners. Also, this structural relation of the carton's clsoure flap 17 with the carton's front wall 12 protects the abrasive material 42 and, therefore; the cutting edge 40 (i.e., prevents contact with the abrasive material) after the carton has been assembled into the knocked-down FIG. 5 configuration, as well as when the carton 10 is erected into use configuration and filled with a roll 61 of sheet material 60 (but prior to opening of that carton for withdrawing the sheet material). This protection for the carton's cutting edge 40 tends to prevent the abrasive material 42 from being significantly damaged during storage of the knocked-down carton 10, and during distribution of the container 10 from the sheet material manufacturer through wholesale and retail outlets to the consumer, so that it retains its as manufactured functional capabilities when the carton is initially opened by a user.

The blank 11 configuration shown in FIG. 5 is the final folded and glued position of the blank, the carton so formed being in knock-down or collapsed configuration. In this configuration the carton 10 may be shipped from the carton manufacturer to the sheet material 60 manufacturer for packaging of sheet material on a roll 61 in that carton. When such packaging is desired, the carton 10 is set-up by erecting same into a tubular configuration from the flat or knock-down configuration shown in FIG. 5, by closing the carton's ends through gluing together of end closure flaps 28, 29 and end walls 24, 25, and by gluing together of the cover's end flaps 32, 34, at each end of the carton, after a roll of sheet material is inserted into the tubular carton. This, of course, makes the fully erected carton 10, with a roll 61 of sheet material 60 therein, available for distribution to the consumer.

In use of the dispenser carton 10 by the consumer, when the roll 61 filled carton is first received it is opened simply by prying the cover's closure flap 17 away from the carton's front wall 12, i.e., by breaking adherence provided by glue spots 55. The use of abrasive strip 44 at the cover's free edge 41, as opposed to, e.g., a metal serrated blade, tends to reduce potential scratches or scrapes on a user's hands during this initial opening step. Thereafter, and whenever access is desired to the carton's interior, finger flap 47 is pivoted outward on fold line 48, gripped by the user, and the carton's cover 15 pivoted from a full closure position to an open position along fold line 22 at the top edge of the carton's rear wall 14. This, of course, allows the sheet material 60 to be withdrawn from the carton (in the direction shown by phantom arrow 56) while retaining the roll 61 in the carton.

With the desired length 62 of sheet material 60 withdrawn by the carton's user, the carton's cover 15 is closed so that the main closure flap 17 overlies the carton's front wall 12, and is disposed in generally parallel relation therewith. In this position, of course, the sheet material 61 withdrawn from the carton's roll 60 is positioned between the inside face 36 of the carton's closure flap 17 and the outside face 37 of the carton's front wall 12. Since the abrasive material 42 is fixed to the carton closure flap's inside face 36, the abrasive material bears directly against one face 57 of the sheet material. And importantly, when pressure (as shown by phantom arrow 45) is exerted on the carton's closure flap 17 normal to that flap and toward the carton's interior, the abrasive material 42 tends to provide a braking action which tends to prevent further withdrawal of sheet material 61 from the roll 60 in the carton's interior in light of the pressured relation established on the sheet material 61 between the carton's closure flap 17 and the carton's front wall 12. This pressure, shown by phantom arrow 45, can be manually exerted by the carton's user simply gripping the carton in one hand and exerting the force with the user's thumb. And because the abrasive material 42 extends from one end of the carton to the other, the braking action tends to be established in greater or lesser amounts across the entire width W'' of the sheet material 51. Therefore, the abrasive material 42 cooperates with the cover's closure flap 17 to provide a cutting edge 40 located at the free edge 41 of a first carton panel, i.e., at the free edge of the carton's closure flap, the abrasive material 42 being adapted to move into and out of facial contact with the outside face 37 of a second carton panel, i.e., the carton's front wall 12, the abrasive material 42 cooperating with sheet material 61 positioned between the two panels when the two panels are pressured against one another, e.g., as provided by finger pressure indicated by phantom arrow 45 when the carton is gripped in one hand, to tend to prevent inadvertent withdrawal of additional sheet material 61 from between those panels (and, hence, from roll 60 within the carton 10) when the desired sheet material length 62 is being torn off at the cutting edge 40.

With the sheet material 61 so positioned in braking relation between the carton's closure flap 17 and the carton's front wall 12, the desired sheet material length 62 is thereafter torn or cut from the roll 60 in the usual tearing fashion from one edge **61*a* to the other 61*b*, i.e., from one end 18 of the carton's closure flap 17 to the other end 19. In this regard, the novel cutting edge structure 40, therefore, is structured to provide a cutting edge 40 at free edge 41 of the cover's flap 17 for sheet material to be stored within that carton, and to cause cooperation of the cover's flap with the carton's front wall 12 when pressured thereagainst to brake the sheet material remaining in the carton for preventing inadvertent withdrawal of the remaining sheet material when a desired sheet length 62 is being cut off through use of the cutting edge 40**.

Having described in detail the preferred embodiment of my invention, what I desire to claim and protect by Letters Patent is:

1. A carton comprising:

a panel having structure that defines a cutting edge, a finger flap formed out of said panel, adjacent said cutting edge, said finger flap being connected on a fold line interiorly of said panel, and said finger flap being configured to preclude significant contact of said finger flap with sheet material being torn through use of said cutting edge during the tearing step, structure defining a notch in the cutting edge of said panel, said finger flap being positioned within said notch, and a backing strip which partially defines said cutting edge, said backing strip being connected to said panel at least in the area of said notch for maintaining a continuous cutting edge across said notch.

2. A carton as set forth in claim 1, said carton comprising abrasive material applied to said backing strip and to a free edge of said panel, said abrasive material and said free edge cooperating to define said cutting edge.

* * * * *